US011242124B2

(12) United States Patent
Gai

(10) Patent No.: US 11,242,124 B2
(45) Date of Patent: Feb. 8, 2022

(54) STEERING SYSTEM FOR A BOAT, A MARINE VESSEL, OR THE LIKE

(71) Applicant: Ultraflex S.p.A., Casella (IT)

(72) Inventor: Marcella Gai, Casella (IT)

( * ) Notice: Subject to any disclaimer, the term of this patent is extended or adjusted under 35 U.S.C. 154(b) by 0 days.

(21) Appl. No.: 16/948,171

(22) Filed: Sep. 5, 2020

(65) Prior Publication Data

US 2021/0070415 A1 Mar. 11, 2021

(30) Foreign Application Priority Data

Sep. 5, 2019 (IT) ..... 102019000015668

(51) Int. Cl.
*B63H 25/00* (2006.01)
*B63H 20/06* (2006.01)

(52) U.S. Cl.
CPC ..... *B63H 25/00* (2013.01); *B63H 20/06* (2013.01)

(58) Field of Classification Search
CPC ..... B63H 25/00; B63H 20/00; B63H 20/06; B63H 20/08; B63H 20/10; B63H 20/12
USPC ..... 114/53, 60, 63
See application file for complete search history.

(56) References Cited

U.S. PATENT DOCUMENTS 5,154,651 A * 10/1992 Binversie ..... B63H 20/10 440/63
5,782,662 A * 7/1998 Icenogle ..... B63H 20/106 440/61 R
8,007,330 B2 * 8/2011 Wong ..... B63H 20/12 440/61 S
8,882,551 B1 11/2014 Quail
9,540,088 B1 1/2017 French
9,718,525 B1 8/2017 Wiatrowski
9,926,060 B1 3/2018 Wiatrowski

* cited by examiner

*Primary Examiner* — Lars A Olson
(74) *Attorney, Agent, or Firm* — Themis Law

(57) ABSTRACT

A steering system for a boat, a marine vessel or the like, having an outboard motor with an underwater propeller and a removable fastening terminal at the hull, includes a steering control member, such as a steering wheel, a rudder bar or a rudder wheel, and an actuator that changes the orientation of the propeller by changing the angular position of the rotation axis thereof relative to the longitudinal axis of the boat. An intermediate framework, positioned between the stationary part of the boat and the fastening terminal of the engine, includes a housing for at least a portion of the drive assembly and/or of the actuator fastened to the intermediate framework.

13 Claims, 3 Drawing Sheets

STEERING SYSTEM FOR A BOAT, A MARINE VESSEL, OR THE LIKE

FIELD OF THE INVENTION

The present invention relates to a steering system for boats, vessels or the like, which is provided in combination with at least one engine of the so-named outboard type, which engine comprises a pusher propeller intended to operate in an immersed condition and a removable fastening terminal at the hull of the boat, in particular at the transom and which system comprises:

at least one steering control member, such as a steering wheel, a rudder bar or a rudder wheel;

at least one orientation-changing actuator to change the orientation of said pusher propeller by changing the angular position of the rotation axis thereof with respect to the direction of the longitudinal axis of the boat, in particular thanks to an angular displacement of the propeller axis around a vertical or substantially vertical axis and anyhow transversal to the rotation axis of the propeller;

said orientation-changing actuator to change the orientation of the propeller is controlled by said steering control member depending on the displacement travel of said steering control member and/or on the displacement speed and/or on the displacement acceleration along said displacement travel so that said steering control member determines the change of the orientation of the propeller according to a predetermined law of transformation of the displacement of the steering control member into a corresponding angular displacement of the axis of the propeller with respect to the longitudinal axis of the boat, a drive assembly of said direction-changing actuator being provided that generates a drive signal of said actuator depending on at least the displacement travel of said steering control member and/or on the displacement speed and/or on the displacement acceleration along said displacement travel;

and at least one energy source being provided that supplies at least said drive assembly of the direction-changing actuator.

BACKGROUND OF THE INVENTION

This type of steering systems is known in the art with different configurations and for different types of boats.

A hydraulic steering device, in particular oleodynamic, is described in document EP3372487 of the same applicant. In this document a steering wheel or a rudder wheel directly drive the shaft of an axial piston pump which, depending on the direction of rotation of the steering wheel, feeds one or the other of two chambers of a double-acting cylinder with a pressurized fluid. The cylinder rod is held stationary and bound to the engine, i.e. to the fastening framework of the engine to the boat, while the cylinder slides along said rod and drives the pusher propeller orientation regarding the longitudinal axis of the boat determining the change of direction.

As shown in document EP3372487, the system members are distributed throughout the boat and must be connected by relatively long pressurized fluid lines. Said conduits must also be relatively large in diameter, so they also constitute a considerable encumbrance when installed.

An alternative solution involves the use of a mechanical transmission, for example by means of push-pull cables acting directly on the steering arm of the engine or by means of a transmission. The cables are placed under traction or pushed by the rotation of a corresponding pulley which is driven by the steering wheel or similar.

Another alternative form of implementation of the well-known systems provides that the actuator of the steering arm movement of the engine is electromechanical or electro-hydraulic being the motion of an engine used to drive an actuation mechanism or to drive a pump to feed a hydraulic or oleodynamic cylinder. In such case, one or more physical parameters that characterize the displacement of the boat's directional variation control member or steering control member is read by a transducer that encodes said one or more physical parameters into an electromagnetic or optical electrical signal. This signal is processed by a control unit that generates a corresponding motor activation signal. Generally, this steering technique is referred to as "Steer by wire", meaning that a steering control signal is transmitted by cable and does not consist of a pulling or pushing mechanism or a pressurized fluid. This type of solution is known from document EP1598267.

Steering systems using hybrid techniques, i.e. where the mechanical or hydraulic manual transmission is just assisted by an electric engine or pump if the necessary pressure is relatively high and therefore the rotation of the steering control member is heavy is described for example in document EP3228523 with reference to a hydraulic steering system such as the one described in document EP3372487.

A further disadvantage of using the well-known system is that the system connection, i.e. the actuator to the engine arm, must be done in a dedicated and ad hoc way for engines of different manufacturers. It does not exist a standard relatively to disposition, conformation and dimensions of the steering arm and these characteristics and values vary from manufacturer to manufacturer and also from engine model to engine model.

SUMMARY OF THE INVENTION

In order to overcome such disadvantages described above, the present invention provides a steering system for boats, vessels or the like, which is provided in combination with at least one engine of the so-named outboard type, which engine comprises a pusher propeller intended to operate in an immersed condition and a removable fastening terminal at the hull of the boat, in particular at the transom and which system comprises:

at least one steering control member, such as a steering wheel, a rudder bar or a rudder wheel;

at least one orientation-changing actuator to change the orientation of said pusher propeller by changing the angular position of the rotation axis thereof with respect to the direction of the longitudinal axis of the boat, in particular thanks to an angular displacement of the propeller axis around a vertical or substantially vertical axis and anyhow transversal to the rotation axis of the propeller;

said orientation-changing actuator to change the orientation of the propeller is controlled by said steering control member depending on the displacement travel of said steering control member and/or on the displacement speed and/or on the displacement acceleration along said displacement travel so that said steering control member determines the change of the orientation of the propeller according to a predetermined law of transformation of the displacement of the steering control member into a corresponding angular displacement of the axis of the propeller with respect to the longitudinal axis of the boat, a drive assembly of said direction-changing actuator being provided that generates a drive signal of said actuator depending on at least the displacement travel of said steering control member and/or on the displacement speed and/or on the displacement acceleration along said displacement travel;

and at least one energy source being provided that supplies at least said drive assembly of the direction-changing actuator, which system is further characterized by having an intermediate framework provided between said stationary part of the boat and the fastening terminal of the engine, which intermediate framework comprises a casing part for housing at least part of said drive assembly and/or said actuator and/or at least part of said drive assembly and/or of said actuator being fastened to said intermediate framework.

According to a first aspect of the invention, it is possible that at least a part of the operating units or elements that compose the system are merged and grouped on said intermediate framework and therefore in proximity of the user, i. e. actuator and outboard engine to be rotated.

This solution is particularly advantageous when the intermediate framework comprises a so-named Jack-plate that provides two connected frameworks so that said frameworks have at least one degree of freedom between them, preferably two, three or more degrees of freedom.

Jack plate shows therefore two parts of framework that can be shifted each other and that are respectively connected one to the boat and the other one to the outboard engine and in order to operate according to the present invention it requires only few dimensional changes.

Frameworks of both parts of Jack-plate can each or alternatively form a housing for at least part of the units that compose the steering system and are essentially already present to allow movements to change the position of the outboard engine regarding the hull. Devices such as the above Jack-plates are described for example in document EP3241735.

According to a form of implementation of the invention, therefore, said framework consists of a so-named jack-plate, i. e. by a framework consisting of two parts connected to each other so that to allow a relative displacement according to at least one degree of translational freedom, said part of said drive assembly and/or said actuator being fastened or housed in a casing combined with at least one of said two framework parts.

The displacement of almost all the operational members or elements of the steering system or at least part of them on said intermediate framework, whether they are only fastened to said framework, whether said framework brings in turn a housing box in which are contained at least part of said organs or said operating elements or whether said frame is conformed for part of it in the shape of a case or box brings the advantage of having all elements grouped and close together and to limit the lengths of cables and/or pipes that may constitute a source of encumbrance and also increase the risk of breakage and therefore failure of the steering system.

In addition, this placement of at least some of the system's operating members or elements on or in the intermediate framework offers the possibility of configuring the steering system according to a wide range of variants.

In a first implementation form variant, the two framework parts are hinged to each other in an angularly displaceable way, one with respect to the other, around a vertical or substantially vertical axis, one of said steering parts being fastened to the boat while the other of said two framework parts being fastened to the terminal of the engine and the steering actuator being configured so that to angularly displace one of said two intermediate framework parts with respect to the other, correspondingly to the angular displacement of the steering control member.

In this case, the rotation support of the outboard engine on its mounting framework is unnecessary and it is expected that this rotation will be inhibited by the use of a block.

An implementation form provides that the engine is an outboard engine provided with a framework that rotatably supports said propeller around a steering axis perpendicular to the axis of the propeller and/or to the longitudinal axis of the boat and which framework can be fastened to the corresponding terminal of said intermediate framework, said engine being provided with a steering arm to control the rotation thereof around the steering axis, said intermediate framework being provided with a locking member for locking said steering arm of the engine in a fixed position.

This makes the steering system largely independent from the specific configuration of the steering arm or steering mechanism provided on the outboard engine, facilitating the implementation of the steering system which can be essentially identical for each type of engine.

An alternative form of execution provides instead that the steering mechanism provided on the outboard engine is used, so that the said outboard engine is equipped with a framework that rotatably supports said propeller around a steering axis perpendicular to the axis of the propeller and/or to the longitudinal axis of the boat and which framework can be fastened to the corresponding terminal of said intermediate framework, being said engine equipped with a steering arm to control the rotation thereof around the steering axis, being said steering actuator fastened to said intermediate framework or to said part of intermediate framework to which the engine is fastened and being said actuator dynamically connected to the steering arm of the engine to control the angular displacement of said steering arm.

Several variants of this implementation form are possible and these variants are described hereinafter.

BRIEF DESCRIPTION OF THE DRAWINGS

The above general characteristics and further features of the invention together with the corresponding advantages of the present invention will result more clearly from the following description of some examples of implementation forms shown in the attached drawings wherein.

DETAILED DESCRIPTION OF EMBODIMENTS OF THE INVENTION

The embodiments described below should not be considered as limiting of the more general inventive concept provided in preceding description, but constitute only examples of realization of such more general technical teachings without limiting the scope of protection of the corresponding claims.

Regarding certain elements and operating members that are described below, the illustration of the claimed inventive teachings does not require detailed descriptions of those elements. However, in the preceding description, published documents and construction parts that are described in detail therein have been referenced several times, being the possible constructive adaptation of described elements falling within the normal design capabilities of a person skilled in the art.

Figure 1:
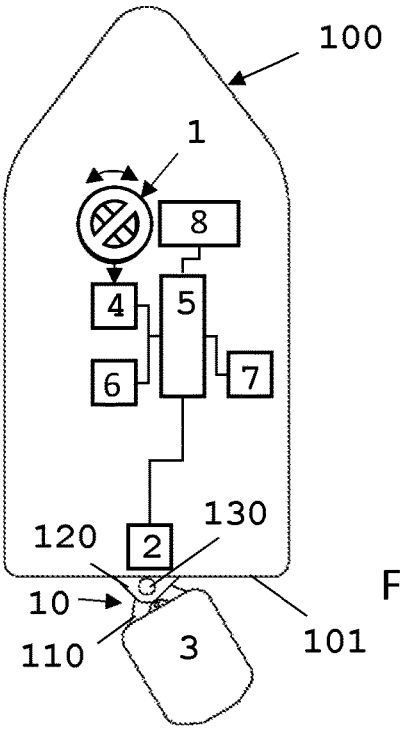
FIGS. 1 to 3 show respectively a detailed view on the transom of a boat provided with a steering system according to the present invention and two plan views above on the whole boat, in one of said two views being shown a block diagram of the steering system.
Figure 2:
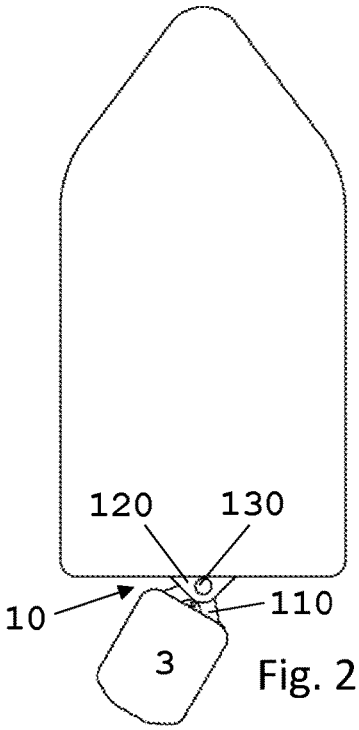
Figure 3:
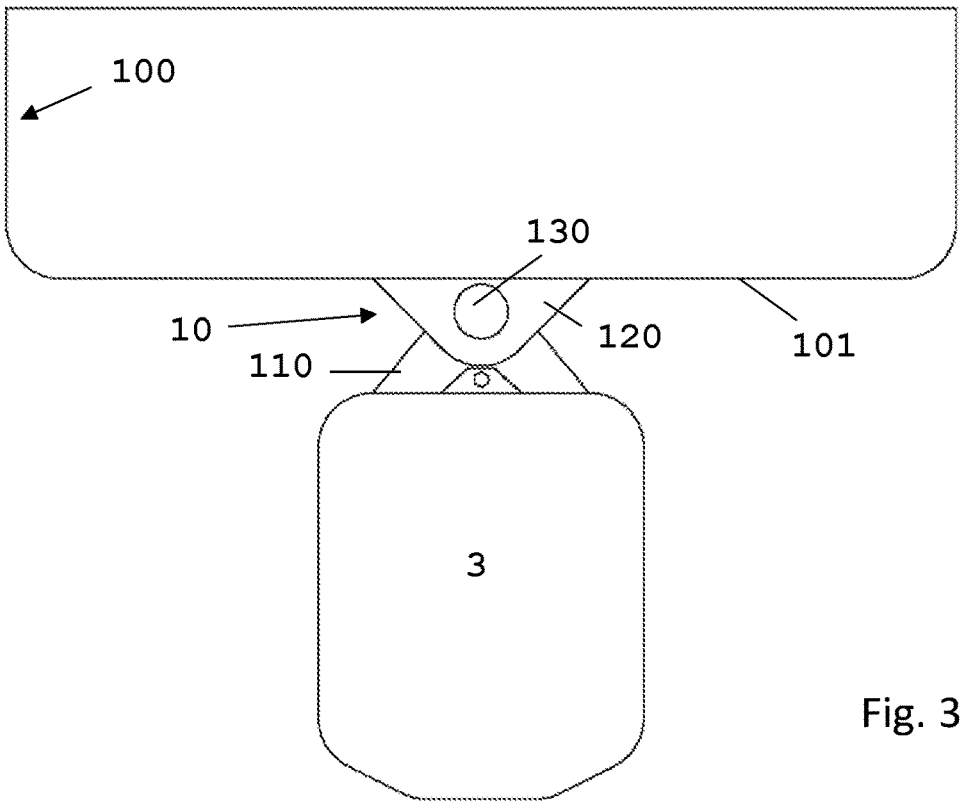

With reference to FIGS. 1 to 3, a first embodiment of the present invention is illustrated therein.

FIG. 1 also shows a block diagram of the steering system principle as a whole. In particular, said system comprises a steering control member 1 which can be displaced along a predetermined stroke and said stroke corresponding to a certain deviation from the straight trajectory parallel line to the longitudinal axis of the boat 100.

Figure shows the steering control member 1 comprising, for example, a steering wheel that can be rotated around its axis in the two directions indicated by the arrow. The displacement of steering wheel 1 is converted into an activation signal of an actuator schematically and generically indicated by block 2.

Different ways of transducing or transmitting the displacement of the steering control member, e.g. steering wheel 1 in this example, to actuator 2 to generate a steering displacement of outboard engine 3 corresponding or related to the displacement of said member 1 or steering wheel 1.

In the implementation form of FIGS. 1 to 3 is shown the so-named system steer by wire, in which the displacement of the steering control 1 is transformed in an electrical drive signal by means of a transducer 4 that transforms the mechanical movement in an electrical signal.

In the electrical signal the values of the physical parameters that describe the displacement of the steering control 1 and that are caused or imposed by the displacement action exerted on the steering control 1 by a user can be encoded.

The electrical drive signals generated by transducer 4 are transmitted to a control unit 5 which runs a control software for actuator 2 which processes corresponding activation signals of actuator 2 by executing a program in which the instructions for the execution of the processing algorithm are coded and which program is stored in a memory 6.

Power for the actuator 2 activation signal and for powering the system's operating units is supplied by a power source 7 such as a battery or the like.

A user communication interface 8 with control unit 5 is provided for inputting commands or settings and for outputting signals, warnings, alarms and other indications generated by control unit 5.

In addition to steering wheel 1, it is also possible to provide other types of steering control devices that can be activated alternately or in parallel to the steering wheel or that can be used to steer the boat in particular working conditions, such as pulling over, docking or other operations.

As alternative to the generation of electrical steering drive signals, it is possible to provide a mechanical/optical transducer that transforms the displacement of the steering control 1 into optical signals, these signals being transformed into electrical signals by the control unit 5.

Other embodiments can provide for a transmission of the directional variation drive imposed by means of steering control member 1, for example of hydraulic type, since said steering control member 1 is used to drive, for example, a pump that feeds a corresponding quantity of pressurized fluid to a steering actuator of hydraulic or oleodynamic type.

In the implementation example shown, the outboard engine 3 is fastened to a part 110 of an intermediate framework 10 which part of framework 110 is hinged to a second part of framework 120 which is fastened to the transom 101 of the boat 100.

Both framing parts 110 and 120 are articulated with each other in an oscillating way around an axis perpendicular to the longitudinal axis of the boat and substantially parallel to the axis and steering of the outboard motor 3.

In a form of implementation, a shaft 130 is rotationally integrated with the framing part 110, while it rotates freely relative to part 120. A engine drives said shaft 130 in rotation according to the activation signals generated by the control unit 5 on the basis of the steering control signals generated by the transducer 4. The engine can be connected directly to shaft 130 or a transmission between the output shaft of the engine and shaft 130 can be provided.

This solution is purely an example because the technician skilled in the art is able to choose between multiple alternatives available at the state of the art as part of his normal design activities.

FIG. 2 shows the system of FIG. 1 with the engine steered in the direction symmetrically opposed to that of FIG. 1 with reference to the central, longitudinal axis of the hull.

FIG. 3 shows a zoomed view of the boat's transom area.

With reference to the present embodiment, it should be considered that generally outboard engines are equipped with a framework for fastening to the transom and that this framework with which the outboard engine is equipped carries the engine unit and stem with the propeller foot in a rotatable way around a steering axis that is perpendicular to the axis of rotation of the propeller, so a rotation of the engine around said steering axis causes an angular displacement of the propeller axis and therefore a change of direction of the boat corresponding to the angular position of said propeller axis with respect to the longitudinal axis of the boat. The steering rotation of the outboard engine can be controlled with a lever that forms the engine control bar by human action or with a steering control arm.

In the system of the present embodiment, the steering control arm of the engine is blocked in the position corresponding to a substantial alignment of the propeller axis with the longitudinal axis of the hull or with an axis parallel to the latter, while the angular displacement of the propeller axis is caused by the oscillation of the framework 110 to which the engine 3 is fastened with respect to the framework 120 integrated in the transom of the boat.

The oscillation axis of the framework part 110 in relation to part 120 is essentially parallel to the steering axis of engine 3. In this case, the steering actuator acts on the steering arm 103 of the engine which is therefore not blocked in relation to the intermediate framework 11.

This does not consist of two parts hinged to each other. In the implementation form of FIGS. 4 to 6, the steering actuator 12 of the engine 3, i. e. the orientation of the propeller rotation axis comprises a circular sector-shaped rack which is mounted symmetrically in relation to the steering arm 103 and the central longitudinal axis of the boat and which is engaged with its toothed sector provided on the radially internal face or intrados with a motorized pinion marked with 13.

Figure 5:
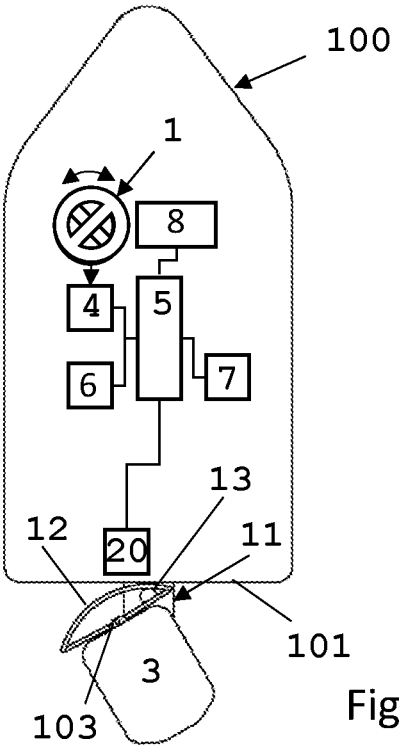

Pinion protrudes from the top of the upper part of the framework 11 in the shape of a box or case and inside said box are housed at least one or more following elements:

the rotation drive engine shown schematically from block 20 in FIG. 5;

and/or the control unit 5;

and/or the power source 7;

and/or memory 6;

with relative connections.

Similarly to previous implementation form the system can be of the steer by wire type, in which the displacement of the steering control 1 is transformed in an electric or optical signal and then processed by control unit 5 that in turn generates the engine activation signal 20 corresponding to the parameters of the displacement of the steering control 1 encoded in the control signal generated by said steering control 1.

Also in this case one or more alternative implementation variants described with reference to the executive example in FIGS. 1 to 3 are possible.

FIG. 5 shows a boat 100 in combination with a block diagram of the steering system which is made in the same way as described with reference to FIG. 1 with the only difference that block 20 shows a pinion rotation drive engine 13.

Figure 4:
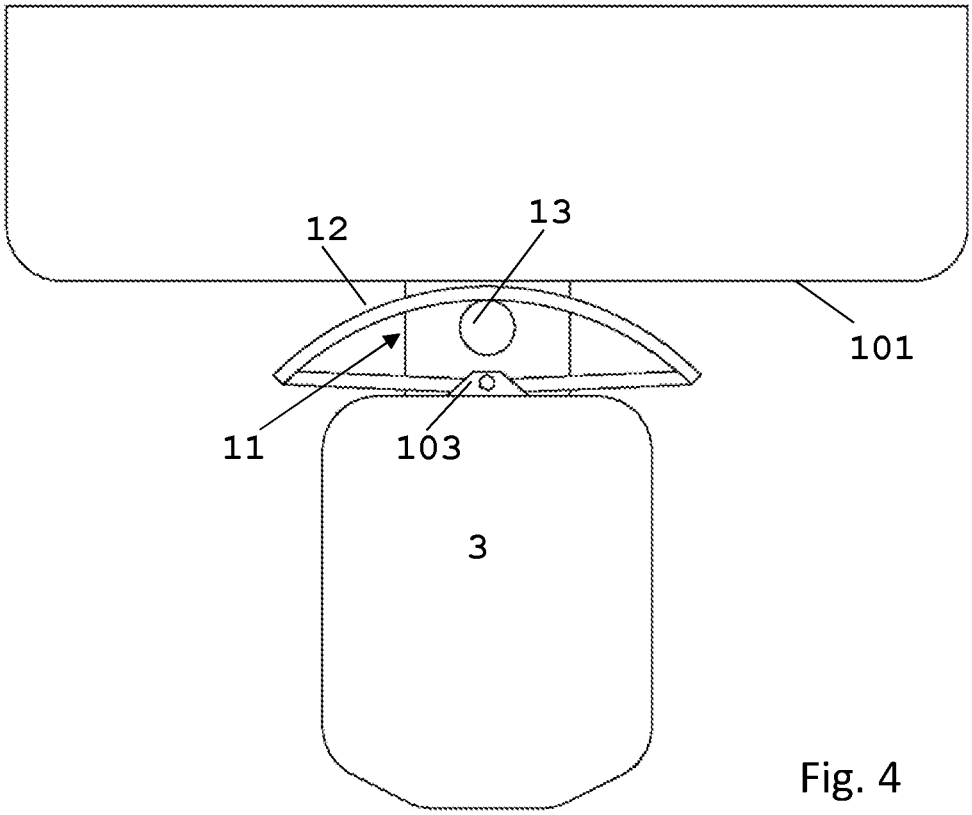
FIGS. 4 to 6 represent three similar views to those of FIGS. 1 to 3 and in which a second implementation form of the invention is represented.
Figure 6:
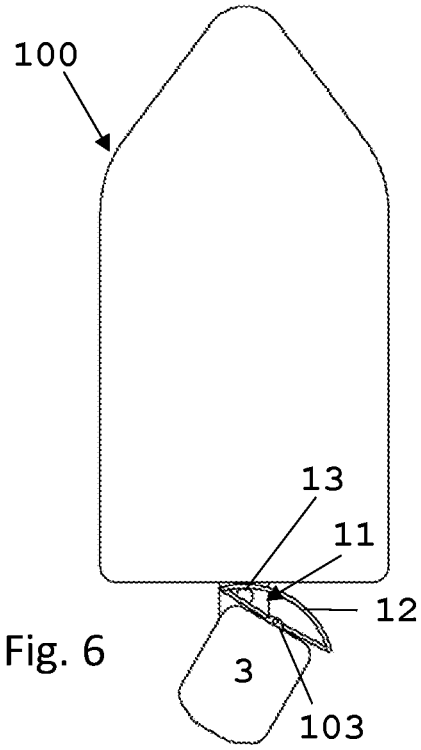
Figure 7:
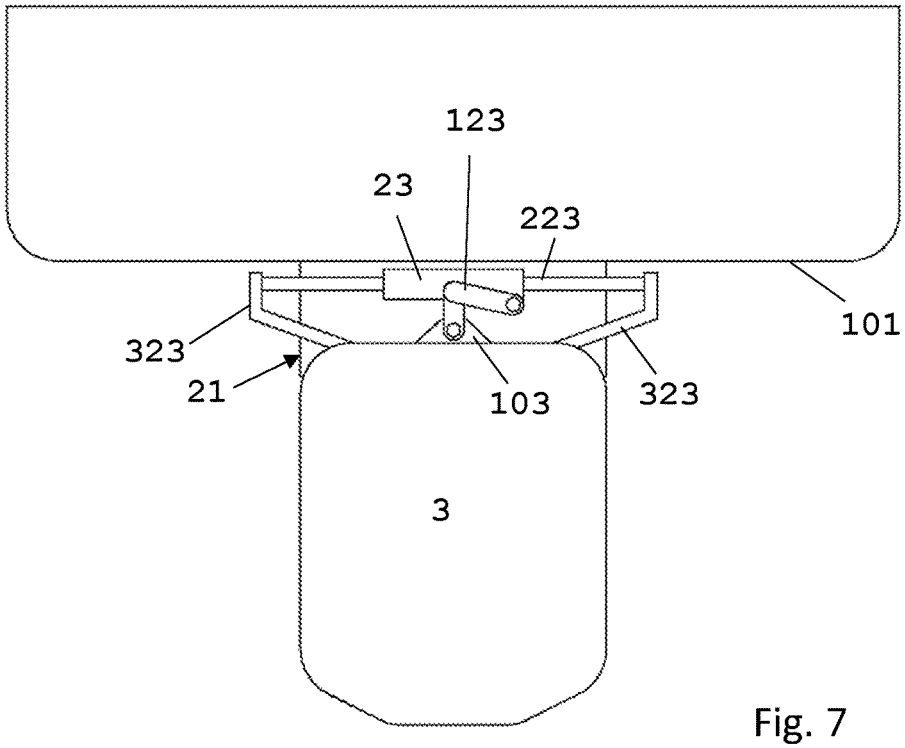
FIGS. 7 to 9 represent similar views to those of FIGS. 1 to 6 and in which a third implementation form of the invention is represented.
Figure 8:
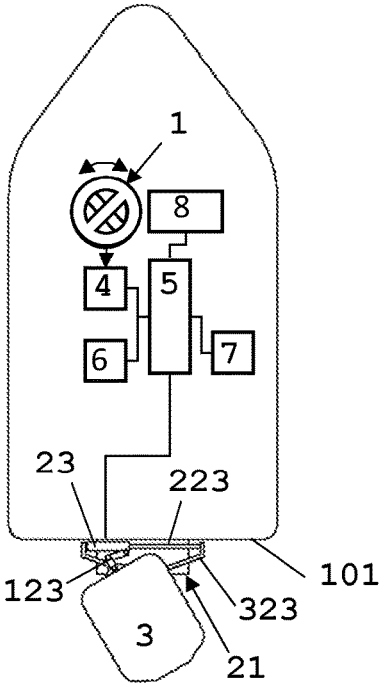
Figure 9:
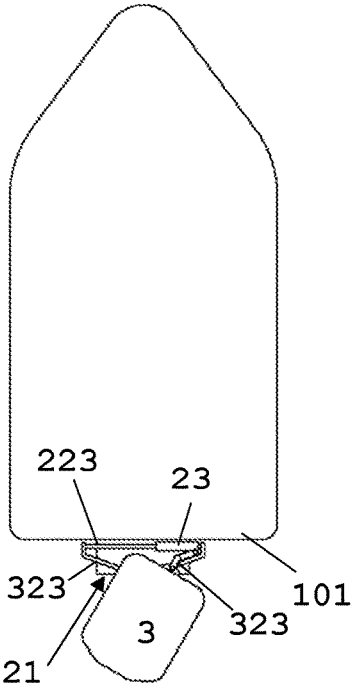

The implementation form of FIGS. 7 to 9 is substantially similar to that of FIGS. 4 to 6. The difference is in the shape of the steering actuator 23 which comprises a double-acting hydraulic cylinder, in particular a cylinder of the type as described in document EP3372487.

In this document as shown in the example, the double-acting actuator cylinder 23 is connected to the steering arm 103 of engine 3 by means of a leverage indicated globally with 123. Cylinder 23 slides in both directions along a steam that is stationary 223 and fastened to engine 3 by means of two end arms 323.

An intermediate framework not limited in the example to the shape of a case and marked with 21 can accommodate one or more different operating units designed to generate the flow of pressurized fluid in one of the two chambers of the double-acting cylinder to cause a translation of cylinder 23 on the measuring stem 323 such that engine 3 is rotated by a steering angle corresponding to that set with the steering control member 1, i.e. with the steering wheel.

FIG. 8 shows a boat 100 in combination with a block diagram of the system similar to FIG. 1 and FIG. 5. In this block diagram it has been chosen to use a steer by wire solution in which the steering control member, i. e. steering wheel 1, generates by means of transducer 4 an electrical or optical steering control signal which is processed by control unit 5 on the basis of a software contained in memory 6, being further provided a power source 7 and possibly a user interface including input and/or output of data, information or diagrams.

In this version a pump is controlled by control unit 5 and feeds the corresponding cylinder chamber 23.

One or more of the following elements is housed in an intermediate framework that can be shaped like a box or housing case:

the hydraulic pressurized fluid supply pump;

the drive motor of said pump;

the control unit 5;

the power source 7, memory 6 and connections of these units to each other.

Construction details of this implementation form can be found in document EP1598267.

An implementation variant provides the use of a system according to the state of the art known and in which the pump is mechanically connected to the steering control member 1, the displacement of said member by operating said pump in order to supply the quantity of fluid under pressure at the preset pressure to the corresponding cylinder chamber.

An implementation variant can provide both the presence of manual pump driven by the steering control member 1, and the presence of a motorized pump that provides the pressurized fluid in the direction agreed to that provided by the manual pump to assist the manual control action, making the manual action lighter and easier, i.e. requiring less manual force to move the steering control member 1. In this case the intermediate framework can house the pump, its drive engine and possibly a lung tank for fluid flow and group of valves and sensors that manages the supply of the delivery flow in the correct pressurized fluid supply branch to one of the two chambers of the cylinder 23.

FIGS. 8 and 9 show engine 3 at the two extreme positions of the steering control member stroke.

Regarding the forms of implementation described above, the variants shown must not constitute a limitation, but are intended as a pure example of implementation of the invention.

In all the embodiments that have been shown and described, the intermediate framework can be advantageously formed by the so-called Jack-plate, i.e. an intermediate framework for fastening the outboard engine to the boat that allows the engine to be displaced according to at least one axis of translation with respect to the transom, or according to two or three axes of translation and possibly according to at least one further axis of rotation, such as an axis of lateral tilting of engine. The different displacement options are described, for example, in document EP3241735.

The above mentioned Jack plates comprise two framing parts that are dynamically bound to each other and can perform relative movements, one to the other, corresponding to the degrees of freedom of displacement of the engine.

In all the forms of implementation shown and described, at least one of said two parts of the door framework or is made at least in part in form of a case or box for supporting or housing at least part of the elements or operating member parts of the steering system according to one or more variants provided.

Preferably the framing part is the one where the engine is fastened.

Regarding the implementation example of FIGS. 1 to 3, the part of framework 110 where the engine is fastened can be at the same time a part of the framework that forms a Jack plate and to which the engine is fastened. In this case the jack-plate presents an additional degree of freedom of displacement of the motor according to the steering axis or the axis of the hinged shaft 130.

Alternatively parts of intermediate framework 110 and 120 form together one of the two parts of the jack-plate and that is the one to which the engine is fastened and which is further fastened in a displaceable way relative to it according to the degrees of freedom of displacement of the engine provided for the jack-plate to a further part of the jack-plate which is in turn fastened to the boat.

The invention claimed is:

1. A steering system for a boat, the steering system being provided in combination with an outboard engine having a propeller configured to operate in an immersed condition and a fastening terminal that is removably disposed at a hull of the boat, the steering system comprising:

a steering control member;

an actuator configured to change an orientation of the propeller by changing an angular position of a rotation axis of the propeller with respect to a longitudinal axis of the boat, the actuator being controlled by the steering control member depending on a displacement travel of the steering control member, on a displacement speed thereof, and/or on a displacement acceleration thereof along the displacement travel, so that the steering control member determines a change in the orientation of the propeller according to a predetermined transformation rule of a displacement of the steering control member into a corresponding angular displacement of the rotation axis of the propeller with respect to the longitudinal axis of the boat;

a drive assembly of the actuator that generates a drive signal of the actuator depending on at least the displacement travel of the steering control member, on the displacement speed thereof, and/or on the displacement acceleration thereof along the displacement travel;

an energy source that supplies at least the drive assembly of the actuator; and an intermediate framework disposed between a stationary part of the boat and the fastening terminal of the outboard engine, wherein the intermediate framework comprises a casing housing at least one portion of the drive assembly and/or of the actuator fastened to the intermediate framework, and/or wherein the at least one portion of the drive assembly and/or of the actuator is fastened to the intermediate framework.

2. The steering system according to claim 1, wherein the intermediate framework comprises a jack-plate, the jack-plate having a jack-plate framework made of two parts connected to each other so as to allow a relative displacement of the two parts according to at least one degree of translational freedom, the at least one portion of the drive assembly and/or of the actuator housed in the casing being combined with at least one of the two parts.

3. The steering system according to claim 2, wherein the two parts of the jack-plate framework are hinged to each other in an angularly displaceable way, one with respect to the other, around a vertical axis, one of the two parts being fastened to the boat and another one of the two parts being fastened to the fastening terminal, the actuator being configured to angularly displace one of the two parts with respect to the other, correspondingly to the angular displacement of the steering control member.

4. The steering system according to claim 1, wherein the at least one portion of the intermediate framework is fastened to the outboard engine and is made in two parts that are hinged to each other with a hinge in an angularly displaceable way, one with respect to another, around a vertical axis, the actuator being configured to angularly displace one of the two parts of the intermediate framework with respect to the other, correspondingly to the angular displacement of the steering control member.

5. The steering system according to claim 4, wherein the outboard engine is provided with a framework that rotatably supports the propeller around a steering axis perpendicular to a steering axis of the propeller and/or to the longitudinal axis of the boat, the framework of the outboard engine being configured to be fastened to a terminal of the intermediate framework, the outboard engine being provided with a steering arm configured to control a rotation thereof around the steering axis of the propeller, the intermediate framework being provided with a locking member configured to lock the steering arm of the engine in a fixed position.

6. The steering system according to claim 1, wherein the outboard engine is provided with a framework that rotatably supports the propeller around a steering axis perpendicular to a steering axis of the propeller and/or to the longitudinal axis of the boat, the framework of the outboard engine being configured to be fastened to a terminal of the intermediate framework, the outboard engine being provided with a steering arm configured to control a rotation thereof around the steering axis of the propeller, the actuator being fastened to the intermediate framework or to the portion of the intermediate framework to which the outboard engine is fastened, a steering actuator being dynamically connected to the steering arm of the engine to control the angular displacement of the steering arm.

7. The steering system according to claim 4, wherein the actuator for angularly displacing the two parts of the intermediate framework comprises a shaft or a hub rotated by an engine, the shaft or hub being coaxial to an axis of the hinge and being a hinge shaft of the two parts, the hinge shaft being rotatably supported with respect to a first one of the two parts and being fastened so as to rotate together with respect to a second one of the two parts.

8. The steering system according to claim 6, wherein the steering actuator comprises an arched rack symmetrically fastened to the steering arm, the arched rack being engaged with a pinion rotated by a drive engine supported or housed in the intermediate framework or in a part thereof to which the outboard engine is fastened, the pinion being supported by a spindle positioned outside of the intermediate framework and engaged with the rack, the rack being also arranged outside of the intermediate framework or the part thereof to which the outboard engine is fastened.

9. The steering system according to claim 6, wherein the steering actuator comprises an actuating cylinder slidingly mounted on a stationary rod, the cylinder being dynamically connected to the steering arm of the outboard engine, an assembly supplying and controlling the actuating cylinder being at least partly integrated in the intermediate framework or in the portion thereof, to which the outboard engine is fastened or which is housed in the casing formed on or fastened to the intermediate framework or to the portion thereof to which the outboard engine is fastened, or being disposed at least partly in a housing formed into or affixed to the intermediate framework.

10. The steering system according to claim 2, wherein the actuator is mechanical, hydraulic, electromechanical, electro-hydraulic, or electric.

11. The steering system according to claim 10, wherein the actuator is electromechanical and comprises an electric motor, the steering control member transmitting a displacement motion to an electromechanical transducer, which transforms displacement into a corresponding electric signal, further comprising an electric power supply source and a control unit that generates a supply signal of the electric motor of the actuator depending on the electric signal corresponding to the displacement of the steering control member, at least the electric motor, the electric power supply, and/or the control unit being mounted on or housed in a housing formed on or fastened to the intermediate framework or to a part thereof.

12. The steering system according to claim 10, wherein the actuator comprises a hydraulic cylinder of double-acting type, wherein the fastening terminal is to a transom of the boat on which the outboard engine is rotatably mounted around a vertical steering axis, wherein the hydraulic cylinder is slidingly mounted on at least one rod coaxial to the cylinder, the rod sealingly protruding from a head of the hydraulic cylinder and bearing a separating piston that divides the hydraulic cylinder into two chambers of variable volume, each of the two chambers having an inlet or an outlet for a hydraulic control fluid, the inlet and the outlet being connected to a delivery and respectively a suction of a pump, wherein the rod is connected to a fastening bracket to non-slidingly fasten the hydraulic cylinder to the outboard engine or to a part of the intermediate framework, so as to allow a relative rotation of the outboard engine with respect to the transom according to an axis parallel to an axis of the rod, wherein the steering control member operates the pump for alternatively supplying a the hydraulic control fluid in pressurized state to one or the other of the two chambers depending on a displacement direction of the steering control member, and wherein operation of the pump occurs alternatively or in combination due to a mechanical rotation of a drive shaft of the pump, which is dynamically connected to the steering control member or due to activation of an electric drive motor of the pump, the electric drive motor being controlled with an electric drive signal generated by a control unit depending on a signal corresponding to a displacement of the steering control member.

13. The steering system according to claim 10, wherein an angular steering displacement of the outboard engine is controlled by a steering device comprising:

a hydraulic pump coupled with a drive motor to supply an operating fluid alternatively according to two flow directions;

a hydraulic actuating cylinder that is connected to a delivery and return of the pump;

a fluid flow distributor that switches a connection of delivery and suction of the pump alternatively to an inlet or outlet of the hydraulic cylinder, which communicate respectively with one of two chambers of the cylinder, wherein the hydraulic cylinder is mechanically articulated to a direction-changing member, the direction-changing member determining a change of direction by changing orientation relative to the longitudinal axis of the boat, wherein an orientation change of the direction-changing member is actuated by the hydraulic cylinder depending on a supply of the operating fluid to the hydraulic cylinder, caused by operation of the hydraulic pump, and wherein the drive motor has inputs for a supply signal to operate the hydraulic pump at the supply of the operating fluid along one of two predetermined flow directions provided;

a steering control member, the steering control member controlling a generator of a steering control signal that comprises a transducer converting the displacement of the steering control member into a corresponding electric signal;

a control unit that transforms the steering control signal into a corresponding supply signal of the drive motor;

an electric power source for the supply signal of the drive motor; and the intermediate framework or a part thereof operating as a support structure, or a housing combined with the intermediate framework or the part thereof.

* * * * *